United States Patent [19]

Henkel et al.

[11] Patent Number: 5,054,445

[45] Date of Patent: Oct. 8, 1991

[54] FUEL INJECTION SYSTEM FOR SELF-IGNITION INTERNAL COMBUSTION ENGINES

[75] Inventors: Dietmar Henkel, Neumarkt; Max Garbisch, Nürnberg, both of Fed. Rep. of Germany

[73] Assignee: MAN Nutzfahrzeuge AG, Munich, Fed. Rep. of Germany

[21] Appl. No.: 612,262

[22] Filed: Nov. 9, 1990

[51] Int. Cl.[5] ..... F02B 3/00

[52] U.S. Cl. ..... 123/300; 123/506

[58] Field of Search ..... 123/299, 300, 506, 458, 123/500, 501

[56] References Cited

U.S. PATENT DOCUMENTS

| | | | |
|---|---|---|---|
| 3,216,407 | 11/1965 | Eyzat | 123/299 |
| 4,201,160 | 5/1980 | Fenne | 123/300 |
| 4,289,098 | 9/1981 | Norberg | 123/299 |
| 4,392,466 | 7/1983 | Mowbray | 123/299 |
| 4,708,116 | 11/1987 | Gaa | 123/506 |
| 4,711,209 | 12/1987 | Henkel | 123/300 |

FOREIGN PATENT DOCUMENTS

| | | | |
|---|---|---|---|
| 724535 | 7/1942 | Fed. Rep. of Germany | 123/299 |
| 748088 | 6/1933 | France | 123/300 |
| 96739 | 11/1922 | Switzerland | 123/299 |
| 538915 | 8/1941 | United Kingdom | 123/299 |
| 562343 | 6/1944 | United Kingdom | 123/299 |

*Primary Examiner*—Carl Stuart Miller

*Attorney, Agent, or Firm*—Robert W. Becker & Associates

[57] ABSTRACT

The invention relates to a fuel injection system for self-ignition internal combustion engines. The noise reduction of Diesel engines requires new injection systems. According to the invention a pre-injection and a main injection is achieved by employing to injection lines of different lengths. The difference in length is selected such that the time difference of the pressure waves for travelling the respective lengths corresponds to the desired time delay between the pre-injection and the main injection. In order to account for the compressibility of the fuel both injection lines are maintained at a standing pressure. The hydraulic effect of the injection lines on each other is prevented by check valves and by-pass valves. The controlled injection significantly reduces the combustion noise.

4 Claims, 3 Drawing Sheets

FUEL INJECTION SYSTEM FOR SELF-IGNITION INTERNAL COMBUSTION ENGINES

BACKGROUND OF THE INVENTION

The present invention relates to a fuel injection system for self-ignition internal combustion engines, in which a fuel volume to be injected is divided into a pre-injection volume and a main injection volume. The fuel injection system comprises an line injection pump and an injection valve. Fuel is supplied from the line injection pump to the injection valve via two injection lines of different lengths, whereby a shorter one of the injection lines, before connecting with the injection valve, is provided with a spring-loaded first check valve.

An effective means for reducing the combustion noise of Diesel engines is the so-called pre-injection. When for this purpose injection devices with conventional fuel injection pumps, which are driven by the cam shaft of the engine, are used (concept of the displacement piston), the following problems are encountered: the respective connecting line between the pumping element and the valve which are relatively long display, besides a pressure dependent volume storage capacity (as a result of the volume compressibility of the fuel) also the usual transfer behavior, due to wave mechanics as a response to the fast volume injection of the fuel. This may be partially solved by adequately dimensioning the stroke of the pumping element piston, but, due to the terminal pressure propagation in the injection line at the speed of sound the detrimental results of the time delay in making available the injection volume may not be overcome.

In order to divide the injection process into a pre-injection phase and a main injection phase it is known from U.S. Pat. No. 4,711,209 to have two injection lines of different lengths which originate at one line injection pump. A first injection line leads directly to a dosage valve unit having a cylinder and a piston, while a second injection line is branched off directly before the dosage valve unit and is connected, via a check valve, to a line originating at the dosage valve unit and opening into the injection valve. Due to the longer first injection line the piston of the dosage valve unit is moved when the pumping action begins and a volume of fuel which corresponds to the cylinder volume is pre-injected. Due to the extension of the first injection line by the second injection line, the main injection is delayed by the additional time required to pass the lengths of the lines. In order to avoid backflow a check valve is provided in the second injection line. A disadvantage of such an arrangement as described above is that there is no flexible, external control of the volume and the starting point of the pre-injection and the main injection Also, there is the volume storage capacity of the injection line to be dealt with, because the fuel may not be considered incompressible any longer.

Injection devices which realize such a control, at least for the main injection, with the aid of two electromagnetically actuated by-pass valves are known from a brochure by Klöckner-Humboldt-Deutz (KHD) published in 1985. With one of these valves, installed in the vicinity of a pumping element, the pressure increase in the injection line is started upon initiation of the valve closing phase (which causes fuel to be injected into the combustion chamber), while a second valve, in the vicinity of the valve holder, serves to initiate a pressure collapse at the injection valve by opening a by-pass so that the injection process is interrupted. An electronic control unit serves to accordingly control the injection (one per working cycle) from the beginning to the end. When the by-pass is closed by the by-pass valve which is situated in the vicinity of the pumping element, the pressure increase phase in the injection line is started. The resulting pressure wave, after the time required to travel the length of the injection line at the speed of sound, leads to the lifting of the valve needle and the subsequent injection process. The injection results in the reduction of the fuel volume at the end of the injection line which is facing the valve holder. Especially at low engine revolutions this may lead to a pressure collapse of an order of magnitude that causes a temporary closing of the valve.

Therefore, in the case of a desired pre-injection this fuel volume reduction should be compensated for by a buffer fuel volume, which is in immediate supply and replenishable, in the vicinity of the valve holder during any operational stage of the engine. This buffer volume of fuel must at least of the same amount as the sum of the fuel volumes of the pre-injection and the by-pass volume (which occurs between the pre-injection and the start of the main injection). To provide a fuel surplus for the pre-injection (by selecting a respective height and a respective slope of the cam of the injection pump) is useful then when the initiation of the termination of the pre-injection is forced in a known manner by a second electromagnetically controlled by-pass valve which is provided in the close vicinity of the valve holder.

The aforementioned pressure collapse independent of its initiation by controlled or uncontrolled pre-injection, is to be expected every time the outlet volume stream is greater than the feed volume stream. This is usually the case with slow displacement speeds of the piston (as a component of the internal injection element of the pump), i.e., when the engine is running at low revolutions and when the lifting stroke of the cam is small. This pressure collapse is especially disadvantageous when, according to practical requirements, a short time interval is desired between the pre-injection and the main injection. The recuperation of the pressure at the injection valve, which also is a factor determining the starting of the main injection, mostly depends on the pressure development up-stream, which is timed according to the speed of sound and is not influenced by the volume removal due to the pre-injection, and may result in a relatively long time span for the pressure build-up at the valve, thereby causing an intolerable great delay of the main injection.

It is therefore an object of the present invention to compensate for the negative influences of the compressibility of the fuel on the injection process which is defined as a function of time and further to suppress the disturbing wave mechanical effects.

BRIEF DESCRIPTION OF THE DRAWINGS

This object, and other objects and advantages of the present invention, will appear more clearly from the following specification in conjunction with the accompanying, in which.

SUMMARY OF THE INVENTION

Figure 1:
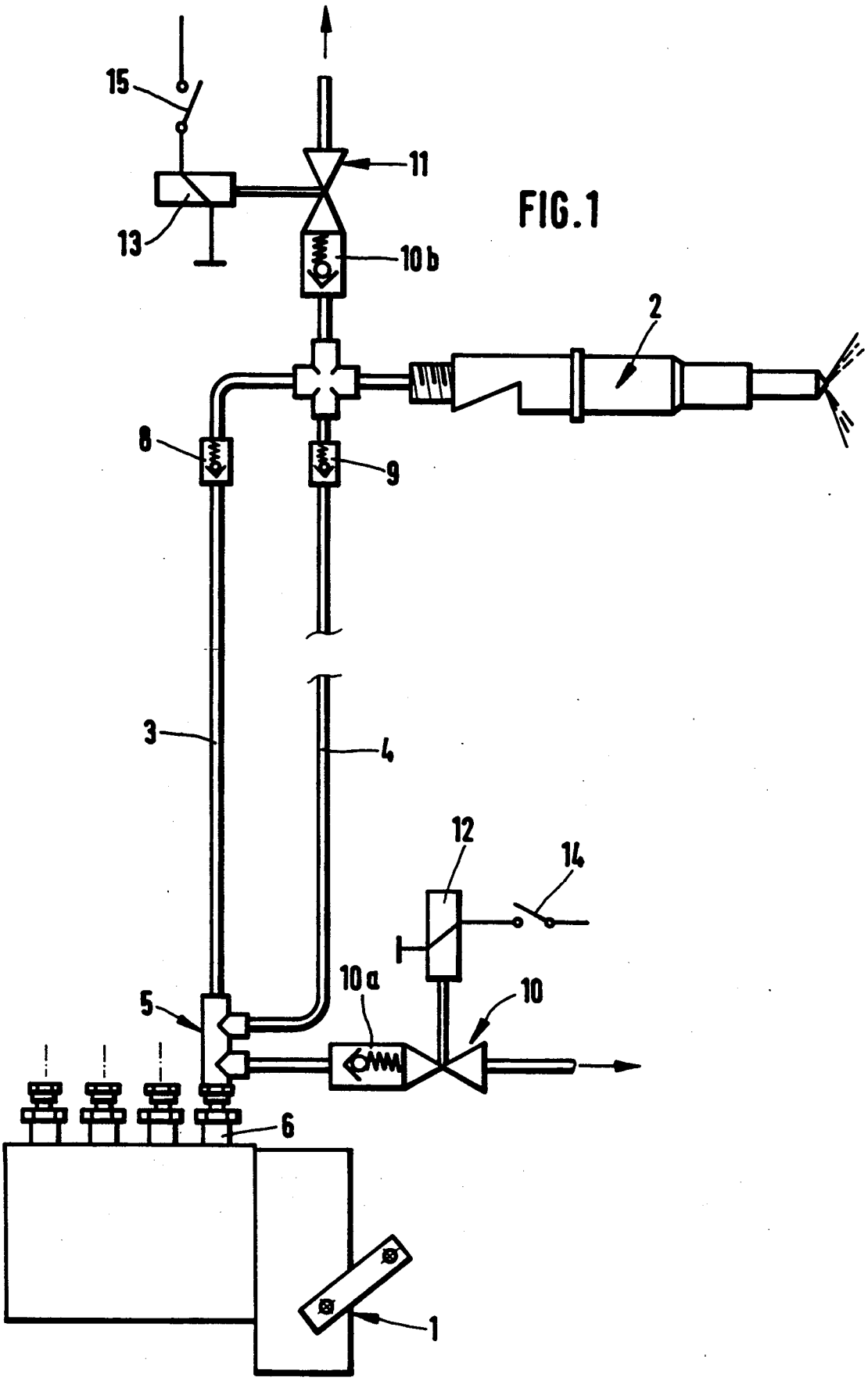
FIG. 1 shows an line injection pump with an injection valve.

The fuel injection system of the present invention is primarily characterized by having a second longer injection line branching off a first distributor portion of a pressure connection of a line injection pump having a first by-pass valve that is electrically actuatable and connected to the distributor portion; both injection lines, at a down-stream end facing the injection valve, open into a second distributor portion that is provided with connections for a second by-pass valve; the injection valve with the second by-pass valve is electrically actuatable and the second spring-loaded check valve is installed in the longer injection line before it opens into the second distributor portion whereby a difference in length between the two injection lines is to be selected such that a time delay is achieved between a pre-injection and a main injection due to different time requirements for a fuel pressure wave travelling the different lengths of the injection lines.

Due to the high standing pressure of the injection lines and the check valves disposed downstream at the injection lines, the negative effect of the compressibility of the fuel and also the undesirable hydraulic effects due to wave mechanical effects on the timing of the injection process are compensated. The injection device is therefore able to follow the desired injection process with reduced delay.

An injection valve which is adapted to the fuel injection system of the present invention is primarily characterized by comprising a valve body and a valve holder and having a valve needle that is loaded by a piston and a closing spring. The valve needle is formed as a differential piston with a pressure shoulder. Fuel is supplied from a connection via a bore to said piston and also via a second bore that is branching off the first bore and via a third bore to a pressure chamber.

Due to the injection valve controlled by pressure, the standing pressure in the injection lines 3 and 4 may be selected at very high values without the valve needle deforming the valve needle seat due to an excessive force of the closing spring.

A further advantageous embodiment of the present invention is characterized by by-pass valves which are connected in series to pressure regulating valves that have checking properties. The injection lines are under a pressure that is higher than the highest compression pressure of the combustion engine when the injection pump is not feeding into the injection lines. The by-pass valves provided with the pressure regulating valves allow for the adjustment of a constant standing pressure in the injection lines. Due to the hydraulic standing pressure the undesired effect of the volume storage capacity is eliminated to a great extent.

Another embodiment of the resent invention is characterized by solenoids with electronic switches being provided at the by-pass valves for their actuating.

DESCRIPTION OF PREFERRED EMBODIMENTS

The present invention will now be described in detail with the aid of several specific embodiments utilizing FIGS. 1 through 4.

A fuel injection system according to the present invention is represented in FIG. 1. The essential components are a conventional line injection pump 1 and an injection valve 2. The line injection pump 1 is connected to the injection valve 2 via a first and a second injection line 3 and 4 whereby both injection lines are branching off a first distributor portion 5 which is connected to a pressure connection 6 of the line injection pump 1. Corresponding to a difference in the travelling time $\Delta t$ of a pressure wave originating at the line injection pump 1, the first injection line 3 is selected to be shorter than the second injection line 4. The injection lines 3 and 4 are connected down-stream to a second distributor portion 7, whereby the first injection line 3 is equipped with a first check valve 8 and the second injection line 4 is equipped with a second check valve 9.

The check valves 8 and 9 are spring-loaded and prevent back-flow into the injection lines 3 and 4.

At the two branch locations of the two injection lines 3 and 4 in parallel, two by-pass valves 10 and 11 are provided which are electrically actuatable. The first by-pass valve 10 is connected directly to the first distributor portion 5 and the second by-pass valve 11 is connected to the second distributor portion 7. A first and a second pressure-regulating valve 10*a* and 11*a* are connected in series to the by-pass valves 10 and 11. They are spring-loaded and serve to maintain a preset pressure in the injection lines 3 and 4 The injection valve 2 is also connected to the second distributor portion 7.

The by-pass valves 10 and 11 may be electrically actuated via respective first and second solenoids 12 and 13. For the actuation of the solenoids 12 and 13 and the by-pass valves 10 and 11 interacting therewith, respective first and second switches 14 and 15 are provided.

Figure 2:
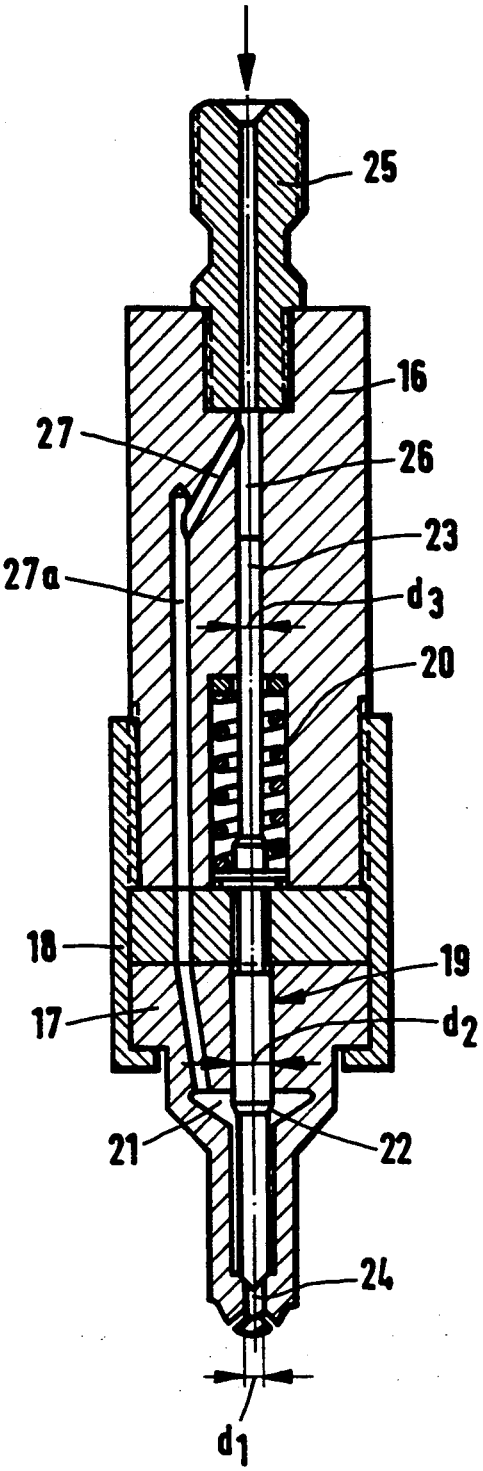
FIG. 2 is a cross-sectional view of an injection valve.

The injection valve 2 of the present invention represented in FIG. 2 differs from conventional injection valves of the prior art. In conformity with the conventional main components of injection valves the injection valve 2 of FIG. 2 comprises a valve holder 16 and a valve body 17 which are connected via a sleeve nut 18. Inside the valve body 17 a valve needle 19 is guided in an axially movable manner. The valve needle 19 is maintained in a closed position by a closing spring 20. The valve needle 19 extends into a pressure chamber 21 and is formed as a differential piston having a pressure shoulder 22. The pressure shoulder 22 serves as a transition to a greater diameter $d_2$. The upper end of the valve needle 19 is formed as a piston 23 having a diameter $d_3$. The valve needle seat 24 at the end opposite the piston 23 has a diameter $d_1$. The diameter ratios are such that $d_3^2 < d_2^2 - d_1^2$. The fuel is supplied via a connection 25 and a first bore 26, which also represents the cylinder of the piston 23. A second bore 27 branches off the first bore 26 and opens into the pressure chamber 21.

The mode of operation of the fuel injection system of the present invention will be described in the following paragraphs.

When a piston of a respective pumping element of the line injection pump 1 begins to pump fuel, the two by-pass valves 10, 11 are in an open position at first. Due to the previous working cycle the injection lines 3 and 4 are still under pressure which corresponds to a pressure forced upon the injection lines 3 and 4 by the pressure regulating valves 10*a* and 11*a* during the opening phase oft he by-pass valves 10, 11 during the final stage of the fuel pumping action. Thus, the newly commencing fuel pumping action forces a discharge of fuel out of the pressure-regulating valve 10*a*, followed, with delay, by the opening of the second pressure-regulating valve 11*a* and discharge of fuel. The fuel which is expanded to atmospheric pressure by this step is recycled to the fuel tank.

Due to the electrical actuation of the solenoids 12, 13 via the respective electronic switches 14, 15 the closing of the by-pass valves 10, 11 is achieved almost delay-free, whereby the pressure increase (above the standing pressure) in the injection lines 3 and 4 is initiated in order to prepare for the pre-injection. When the pressure build-up at the end of the first injection line 3 reaches a value that surmounts the opening pressure of the injection valve 2, the fuel injection into the combustion chamber of the piston is initiated by the lifting process of the valve needle 19 (FIG. 2).

Since the speed of the pressure build-up and also the amount of the pressure gain in the area in front of the injection valve are basically determined by the additive effect of two overlapping pressure waves, one of which is travelling down-stream towards the valve holder and the other, due to reflection, is moving up-stream along the closed valve needle seat, a volume discharge is possible via the injection action into the combustion chamber, which yields the needed fuel for the pre-injection (the end of which is determined by the opening of a by-pass valve due to the electrical actuation of a solenoid), but also leads to an undesired pressure collapse.

This pressure collapse, which preferably occurs at low engine revolutions, is caused by the slow displacement speed of the piston of the pumping element, but also by the effect of pressure increase as a result of two opposite pressure waves as described above. The pressure increasing effect results in a volume stream discharge during the pre-injection which, depending on the conditions of the pumping element such as, for example, the pre-stroke and the cam shape, may be greater than the fuel volume stream that is pumped from the displacement piston of the pumping element into the injection line at this very moment. When the fuel pressure in the valve holder, due to the termination of the overlap of the pressure waves (the reflected pressure wave which was travelling up-stream in the injection line towards the line injection pump has passed and departed the end facing the valve holder) and due to the relatively high volume discharge decreases below the level of the opening pressure of the injection valve the closing action of the injection valve is initiated.

In practice, due to the injection line length, it takes too much time for the pressure to build up at the injection valve to reach a level at which the initiation (by a control) of the main injection, in a suitable time frame, may be carried out by closing the by-pass valve. This detrimental effect may be explained by the down-stream travelling time, at the speed of sound, of the pressure development (in the upper portion of the first injection line) which is undisturbed by the volume discharge.

The present invention now provides a solution to the aforementioned problems. According to the present invention, a second pressure wave is generated with a delay corresponding to the desired time interval between the pre-injection and the main injection at the injection valve in order to yield the volume required for the main injection. This may be achieved by providing a second injection line 4 in parallel to the first injection line 3. The difference in lengths is to be selected such that depending on the different travelling times of the pressure waves the desired delay between the pre-injection and the main injection is reached.

In order to prevent the pressure wave, which arrives delayed at the end of injection line 4, from introducing fuel into the end of the first injection line 3, which is under reduced pressure and is facing the valve holder 16, the injection line 3 is equipped with a first check valve 8. In the same manner the injection of fuel into the end of the second injection line 4 by the first pressure wave that reaches the end of the injection line 3 first has to be prevented. Thus, a second check valve 9 is provided at the end of injection line 4 facing the valve holder 16.

A further embodiment of the present invention is the combination of the by-pass valves 10 and 11 with respective pressure-regulating valves **10*a* and 11*a*. Due to these pressure-regulating valves, the fuel pressure may only decrease to a standing pressure during the so-called outlet phase (the pressure-regulating valves 10*a* and 11*a*** are open). The standing pressure is determined by pre-loaded springs and is set to an equal value at both pressure-regulating valves. The standing pressure also prevails when the pumping element is inactive.

The introduction of a high standing pressure serves the purpose to make available portions of the fuel-supplying displacement movement of the pump element piston for generating an additional fuel volume to be injected by the injection valve. These portions were not unavailable before, because they only served to create the necessary compression volume during the build-up phase of the injection line pressure. Such losses in the fuel supply may be tolerated during the pressure build-up phase for the preparation of the pre-injection, but during the subsequent, extremely fast pressure build-up in the time interval between the terminated pre-injection (with subsequent pressure collapse) and the starting main injection this creates an intolerable volume deficit of the injection volume needed. A high standing pressure therefore ascertains a fast pressure generation after the completion of the pre-injection, especially at low engine revolutions.

It is expedient to select the standing pressure of the injection lines as high as possible due to the aforementioned reasons. A limiting factor, however, is the low opening pressure required for most of the conventional injection valves. Increasing the opening pressure is met by the following problems as set forth in the form of a diagram represented in FIG. 3. The shown force-pressure diagram of a conventional injection valve represents the relation between the force at the valve needle shaft (vertical axis) and the pressure at the valve holder (horizontal axis). The straight line between the points O and B shows the course of the pressure-induced force at the valve needle body. At point B, a force $F_2$ is generated by the opening pressure $P_0$ which equals the opposing force of a spring which presses the valve needle into its seat. Even an insignificant increase of the pressure in the injection lines lifts the valve needle, which causes the well-known increase of the pressure working surface of the valve needle. This increase in the pressure working surface (at the same pressure) leads to a sudden increase of the valve needle power (straight line between B and C) in the direction of the opening until the valve needle reaches its position of contact. When the pressure in the injection lines decreases to the closing pressure $P_s$, the force of the valve needle follows the path of the straight line between C and D. At the point D the force of the valve needle falls below the spring force $F_2$ so that the valve needle falls back into its seat. This also causes a decrease of the hydraulic working surface at the valve needle (straight line between D and E).

The impact energy which is generated in the form of elastic deforming work at the valve needle seat is determined by the spring force $F_2$ and the speed of the decrease of the pressure in the injection lines. When the decrease in pressure of the injection lines requires less time than needed by the valve needle to travel back from the abutment that limits the opening path into its seat (which occurs occasionally), then the elastic deformation work is exclusively determined by the spring force $F_2$ and the distance the valve needle has travelled. Since modern injection systems already have a high impact speed of the valve needle there are concerns about further increasing the spring force $F_2$ which may result in exceeding the allowed surface pressure at the seat of the injection valve, a system was sought after that generates the required closing force but yields lesser impact energy when closing the valve.

The injection valve of FIG. 2 operates as follows: The fuel which is under high pressure enters the pressure chamber 21 via the pressure fast connection 25 that is attached to the valve holder 16 and via the second and third bores 27 and 27*a*. The fuel pressure acts on the pressure shoulder 22 in the form of a ring surface the size of which corresponds to the diameter difference between $d_2$ (diameter of the shaft of the valve needle) and $d_1$ (diameter of the valve seat). A further hydraulic working surface for the fuel pressure is the face of the piston 23 (circular surface with a diameter $d_3$).

The position as well as the movement of the valve needle 19 are controlled by a total of three forces acting directly upon the valve needle: the collaborating forces in the direction of the valve closing, i.e., the force of the closing spring 20 and the force generated at the piston 23 by the pressure of the injection lines, and the third force acting in the opposite opening direction of the valve by acting upon the pressure shoulder 22 (in the pressure chamber) of the valve needle 19.

Figure 4:
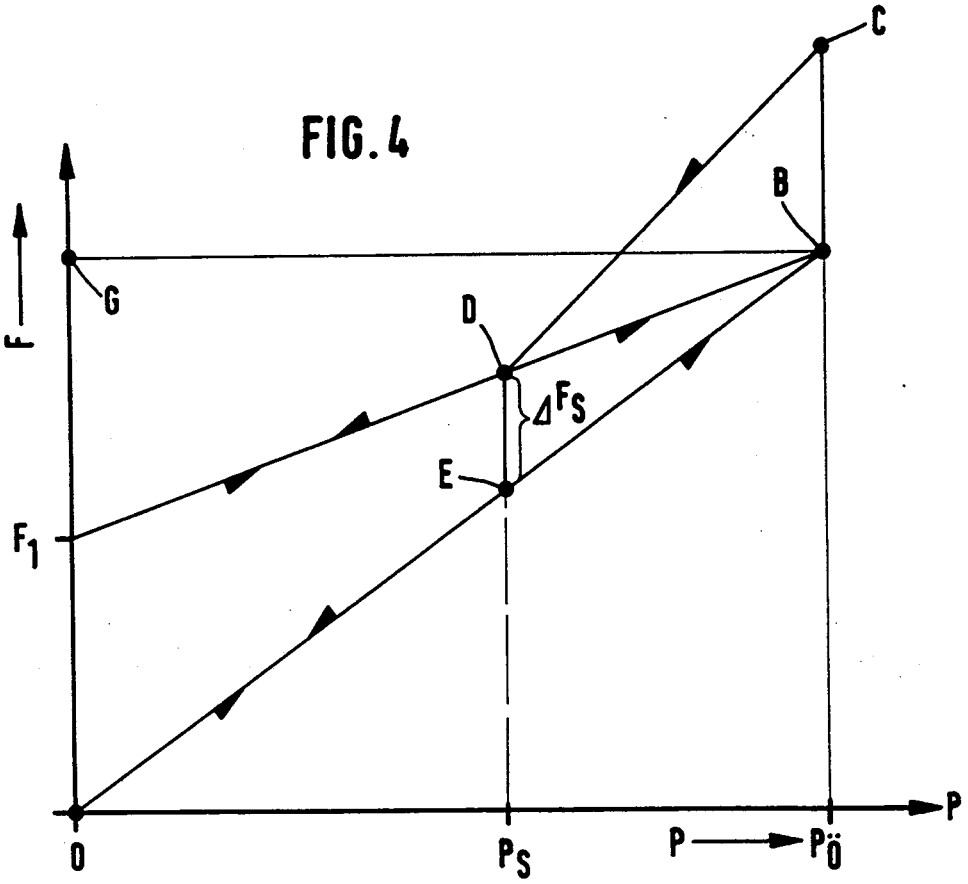
FIG. 4 represents a force-pressure diagram of an injection valve of the present invention.

The results of these measures will be explained with the aid of the force-pressure diagram represented in FIG. 4. With the increase of the pressure in the injection lines the force, resulting from the product of the pressure in the injection line and the hydraulic working surface (cross-section of the ring surface according to the diameter difference $(d_2-d_1)$), acts upon the shaft of the valve needle 19 in the opening direction. This is represented in the diagram as a straight line between the points O and B. At the same time, the closing force, represented by the summation of the spring force $F_1$ of the closing spring 20 and the additional hydraulic force (product from the pressure in the injection line and the circular cross-section $d_3$ (piston 23, FIG. 2)), increases to a value which at the point B is equal to the valve needle closing force. B therefore represents the intersection of the straight lines of the closing and opening forces. At point B, the resulting sign reversal of the summation force that is acting on the valve needle determines the opening pressure and the amount of the lifting force of the valve needle. The opening force is represented by the following equation:

$$P_O = \frac{4\,F_1}{\pi\,(d_2^2 - d_1^2 - d_3^2)}$$

When the pressure in the injection line surmounts the opening pressure $P_0$, an abrupt increase of the opening force due to the working surface increase of the valve needle to a value corresponding to the diameter $d_2$ takes place, resulting in an acceleration of the valve needle 19 (opening) until its shoulder contacts the intermediate piece (straight line B-C). The subsequent injection of the fuel into the combustion chamber causes the pressure in the injection lines to drop and after the injection is complete the opening force at the valve needle decreases according to a mathematical relation as represented by the straight line section between C and D. The point D represents the intersection between the course of the closing and the opening forces and determines the so-called closing pressure:

$$P_S = \frac{4\,F_1}{\pi\,(d_2^2 - d_3^2)}$$

The closing of the valve needle takes place as soon as the pressure drops below the closing pressure. When the valve needle falls back into its initial position, an immediate partial collapse of the opening force, according to the straight line section D-E, occurs which is due to the decrease in the hydraulic working surface. The working surface is reduced from $$f_1 = \pi\,\frac{d_2^2}{4} \text{ to } f_2 = \frac{\pi}{4}\,(d_2^2 - d_1^2).$$

Figure 3:
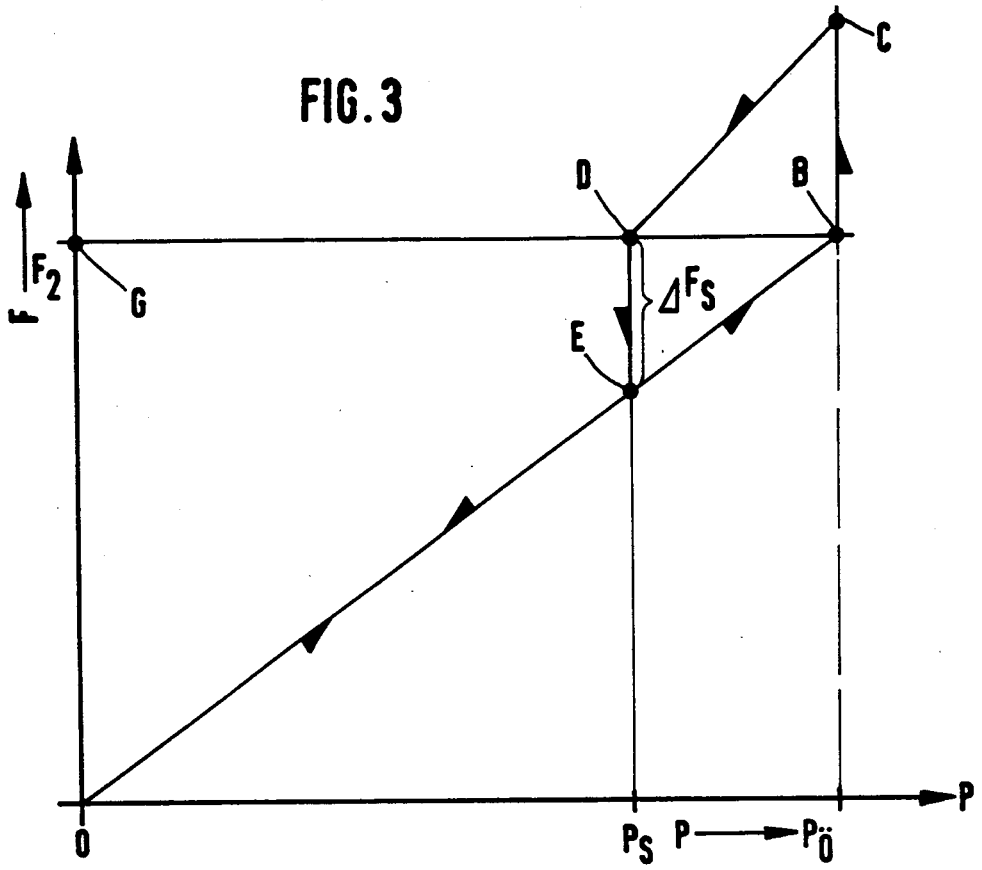
FIG. 3 represents a force-pressure diagram of a conventional injection valve.

The diagram shows clearly that, for identical opening pressures in a conventional and in the inventive system, in a system in which the closing pressure of the spring is supported by an additional hydraulic force (generated with the assistance of the pressure of the injection line), the force of the spring may be selected as low as desired when the hydraulic working surfaces are carefully selected and adjusted. This is in contrast to a conventional system in which the closing force is determined by the closing force of the spring alone (FIG. 3).

Accordingly, it is not necessarily required to reinforce the closing spring, when a higher opening pressure is required (for example, for the introduction of a relatively high standing pressure at a different location in the system) because a closing component that is controlled by the pressure in the injection lines may be introduced instead. It may also be noted that this method of increasing the actuating pressure also results in a favorable droplet size distribution during the fuel atomization which results in better fuel mixing properties for the purpose of reducing the amount of soot in the exhaust gases as well as improving the cold start properties.

The present invention is, of course, in no way restricted to the specific disclosure of the specification, examples and drawings, but also encompasses any modifications within the scope of the appended claims.

What we claim is:

1. In a fuel injection system for self-ignition internal combustion engines, in which a fuel volume to be injected is divided into a pre-injection volume and a main-injection volume, said fuel injection system comprising a line injection pump and an injection valve, with fuel being supplied from said line injection pump to said injection valve via two injection lines of different lengths, with a shorter one of said injection lines, before connecting with said injection valve, being provided with a spring-loaded first check valve, the improvement wherein:

a longer one of said injection lines branching off a first distributor portion of a pressure connection of said line injection pump with a first by-pass valve, that is electrically actuatable, being connected to said distributor portion, and with both injection lines, at an down-stream end facing said injection valve, opening into a second distributor portion that is provided with connections for a second by-pass valve, that is electrically actuatable, and said injection valve, and with a second spring-loaded check valve being disposed in said second longer injection line before said second longer injection line opens into said second distributor portion, whereby said difference in length between said two injection lines and is such that a time delay is achieved between a pre-injection and a main injection due to different time requirements for a fuel pressure wave traveling said different lengths of said injection lines.

2. A fuel injection system according to claim 1, in which said injection valve, comprising a valve body and a valve holder, has a valve needle that is loaded by a closing spring, with said valve needle being formed as a differential piston with a pressure shoulder and remote therefrom a further piston, with fuel being supplied from a connection via a bore to said further piston and also via a second bore that is branching off said first bore and via a third bore to a pressure chamber that surrounds said pressure shoulder.

3. A fuel injection system according to claim 1, in which said by-pass valves are connected in series with pressure regulating valves having checking properties, and with said injection lines being under a pressure that is higher than a highest compression pressure of said combustion engine when said line injection pump is not feeding into said injection lines.

4. A fuel injection system according to claim 1, in which solenoids with electronic switches are provided at said by-pass valves for actuation thereof.

* * * * *

UNITED STATES PATENT AND TRADEMARK OFFICE

CERTIFICATE OF CORRECTION

PATENT NO. : 5,054,445

DATED : Oct. 8, 1991

INVENTOR(S) : Dietmar Henkel et al

It is certified that error appears in the above-identified patent and that said Letters Patent is hereby corrected as shown below:

On the title page, insert the following:

-- [30] Foreign Application Priority Data

Nov. 15, 1989 [DE] Fed. Rep. of Germany....39 37 918 --.

Signed and Sealed this

Twenty-third Day of February, 1993

*Attest:*

STEPHEN G. KUNIN

*Attesting Officer*

*Acting Commissioner of Patents and Trademarks*